United States Patent [19]

Parsonage et al.

[11] 3,934,858

[45] Jan. 27, 1976

[54] METHOD AND APPARATUS FOR MIXING FOUNDRY MATERIALS

[75] Inventors: Raymond Arthur Parsonage, West Bromwich; Harold Higgs, Wolverhampton, both of England

[73] Assignee: Fordath, Limited, West Bromwich, England

[22] Filed: Dec. 17, 1973

[21] Appl. No.: 425,231

[30] Foreign Application Priority Data

Apr. 24, 1973 United Kingdom ..... 19442/73

[52] U.S. Cl. ..... 259/8; 259/161; 259/165; 259/178 R

[51] Int. Cl.[2] ..... B01F 7/24

[58] Field of Search ..... 259/7, 8, 23, 24, 43, 44, 259/107, 108, 66, 67, 122, 178 R, 178 A, 164, 165, 166, 161

[56] References Cited

UNITED STATES PATENTS

| | | | |
|---|---|---|---|
| 2,074,673 | 3/1937 | Sackett | 259/8 |
| 3,420,506 | 1/1969 | Gurley | 259/8 |

*Primary Examiner*—Robert W. Jenkins
*Attorney, Agent, or Firm*—Klarquist, Sparkman, Campbell, Leigh, Hall & Whinston

[57] ABSTRACT

A method of, and apparatus for, mixing foundry sand, resin binder and catalyst, wherein sand/resin and sand-/catalyst mixtures are prepared separately in continuous mixers and conveyed to a final mixing chamber having a vertical high speed rotating shaft with downwardly inclined mixer blades and upwardly inclined deflector blades.

6 Claims, 3 Drawing Figures

METHOD AND APPARATUS FOR MIXING FOUNDRY MATERIALS

BACKGROUND OF THE INVENTION

FIELD OF THE INVENTION

This invention relates to a method and apparatus for mixing foundry aggregate (hereinafter referred to by the expression "sand") and binder to provide a mixture for making moulds and cores to be used in casting operations.

The invention is concerned with the provision of a mixture in which sand is mixed with a curable binder which may be a synthetic resin, and a catalyst which accelerates the curing and setting of the binder so as to speed up production of castings by cutting down on the time taken for the setting of moulds and cores. Over recent years the aim of manufacturers of binders and catalysts has been to produce such materials which will further shorten the curing and setting time and binders and catalysts have now been brought into use to provide a mixture setting time of only a few minutes, which time may in some cases be less than five minutes. In particular, there has been considerable development in this direction in the field of cold setting binders, so called because they do not require any heating to effect curing which takes place very rapidly "in the cold." The present invention is particularly, but not exclusively, concerned with method and apparatus for mixing foundry sand with these cold setting binders and catalysts.

The introduction of these rapid hardening or rapid setting binders has brought about complications in connection with the apparatus which is used for mixing the sand, binder and catalyst mixture because of the fact that the curing or setting commences as soon as the binder and catalyst are brought together and thus the process of mixing and discharging of the mixture into mould boxes and core boxes must be rapid enough to avoid any premature setting of the sand mixture in the apparatus itself which would lead to clogging and eventual stoppage of the apparatus. A further drawback to the use of these rapid setting binders is that any residual mixture in the apparatus will set and clog the apparatus if it is not cleared out rapidly.

DESCRIPTION OF THE PRIOR ART

There have been several proposals hitherto to overcome these problems based upon apparatus in which the sand is divided into two parts, one part being mixed with the appropriate amount of binder and the other part being mixed with the appropriate amount of catalyst and these two primary mixtures being eventually brought together in a final mixing chamber where the sand/binder mixture and sand/catalyst mixture are mixed before final discharge to the mould or core box. Because reaction between the binder and catalyst commences immediately the two primary mixtures come together in the final mixing chamber, most of these prior proposals have been based upon the idea of using compressed air to blast the mixture from the final mixing chamber and, in some cases, to also use compressed air blast to achieve the final mixing. However, this limits the apparatus to working on "batch" operations allowing only the production of pre-determined sized batches of mixtures one after another and does not allow an apparatus producing a continuous mixture for filling a number of moulds or core boxes without interruption on a continuous production basis. Also, the use of compressed air blasts alone at the final mixing operation does not provide a reliable complete mixing with the result that in the mixture as discharged there can be "dead areas" where the primary mixtures of sand/binder and sand/catalyst have not been brought together.

SUMMARY OF THE INVENTION

The object of the present invention is to provide an improved method and apparatus for the final mixing of the two primary mixes of sand/binder and sand/catalyst so as to reduce or eliminate substantially the aforesaid problems of premature setting of the final mixture, and to permit of a continuous production of foundry sand mixture to be provided when required.

Thus according to one aspect of the invention there is provided a method of producing a foundry mixture of sand and rapid setting binder comprising separately preparing a sand/binder mixture and a sand/catalyst mixture, separately conveying said mixtures to a final mixing chamber wherein the material comprising said two mixtures is caused to descend in a substantially vertical direction to a discharge aperture, and interrupting the path of descent of the material towards said aperture by means of moving agitators which act to deflect portions of the material in an upwards direction and against the general downwards flow of the material.

Thus, according to the method, in the final mixing chamber parts of the mixture are all the time being thrown back up into the remainder of the mixture whilst overall there is a general resultant movement downwards towards the discharge aperture. Thus, instead of a smooth flow towards the discharge aperture there is a "turbulent" flow which, as well as ensuring an intimate mixing of the two parts, namely sand/binder mixture and sand/catalyst mixture, also eliminates the possibility of the occurrence of any "dead" areas in the discharge chamber where premature setting of the mixture might commence.

According to a further aspect of the invention there is provided apparatus for carrying out the aforesaid method comprising a pair of mixer and conveyor units, one for producing a sand/binder mixture and one for producing a sand/catalyst mixture, a final discharge chamber having a mixture discharge aperture at its lower end and having said mixer and conveyor units discharging into its upper end, a rotatably driven shaft extending downwardly and centrally through said discharge chamber and deflector blades fixed to said shaft at spaced positions therealong, each such deflector blade being so shaped and positioned as to deflect portions of the downwardly descending mixture in an upwards direction.

Preferably, in addition to said deflector blades there are further blades fixed on the shaft which act as mixer blades and which are arranged so as to be downwardly inclined and conveniently most of the blades are arranged in groups of three, there being two mixer blades and one deflector blade in each group, with a sequence of a number of mixer blades only towards the discharge point.

The discharge chamber is preferably of inverted frustoconical form and the blades are so shaped and arranged that portions of the peripheries of the blades engage the internal surface of the chamber such that the whole or substantially the whole of the internal surface of the chamber is swept by the periphery of the blades.

One embodiment of the invention is hereinafter described by way of example with reference to the accompanying drawings wherein:

DESCRIPTION OF PREFERRED EMBODIMENT

Figure 1:
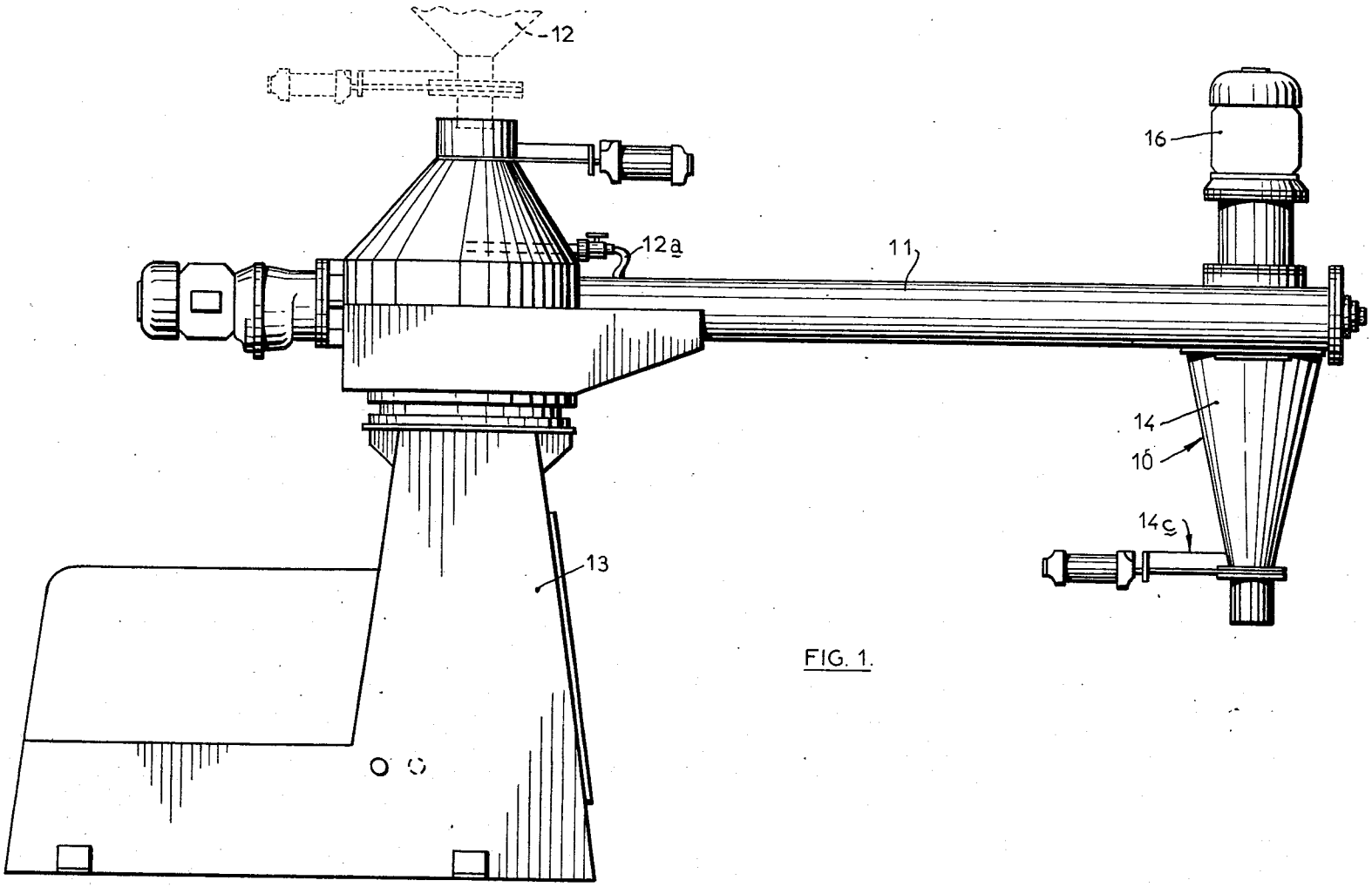
FIG. 1 is a side view showing a complete apparatus for carrying out the method according to the invention.

With reference to FIG. 1, with the exception of the discharge chamber arrangement, generally indicated by reference numeral 10, the remainder of the apparatus is of generally known construction and is hereinafter described briefly as being one form of apparatus for mixing and conveying separately the sand/binder and sand/catalyst mixtures for delivery to the final mixing chamber.

Figure 2:
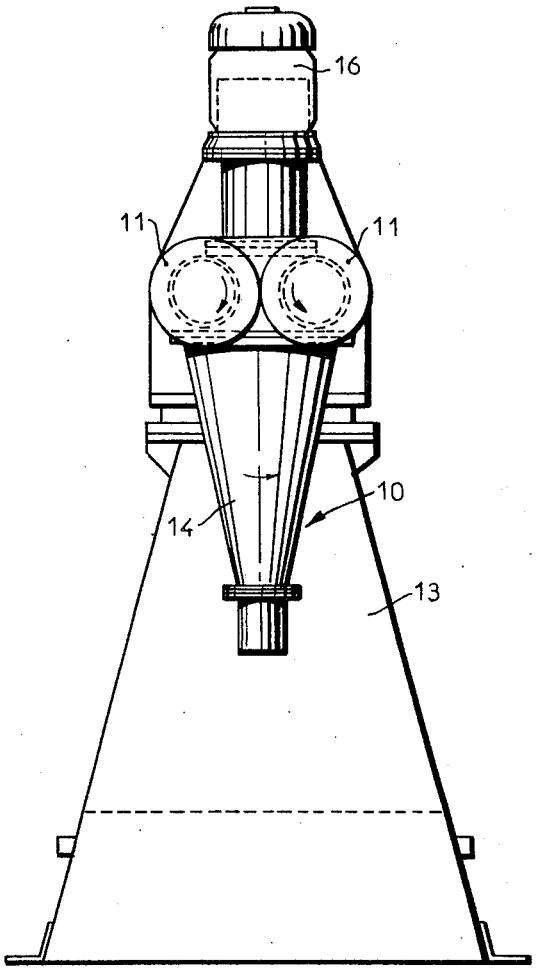
FIG. 2 is an end-on view of this apparatus and FIG. 3 is a perspective view to an enlarged scale showing the final discharge chamber and the interior thereof.

As shown in FIGS. 1 and 2, there are two screw conveyor type mixer units of known form indicated at 11 and disposed in side by side relationship and these are fed with sand from hoppers, indicated at 12, and measured quantities of binder in the one case and catalyst in the other case are introduced into the screw conveyor units at 12*a* so that mixing of the sand/binder and sand/catalyst mixtures takes place during the conveying of the mixtures along the conveyor tubes to the discharge ends where the two separate mixtures are discharged into the final mixing chamber 10. Also in known manner, the mixer conveyor units 11 are supported rotatably upon a pedestal 13 which houses ancillary parts of the apparatus such as the pumps for binder and catalyst. A detailed description of this part of the apparatus is not considered necessary as it will be known to those skilled in the art and is given by way of example only.

Figure 3:
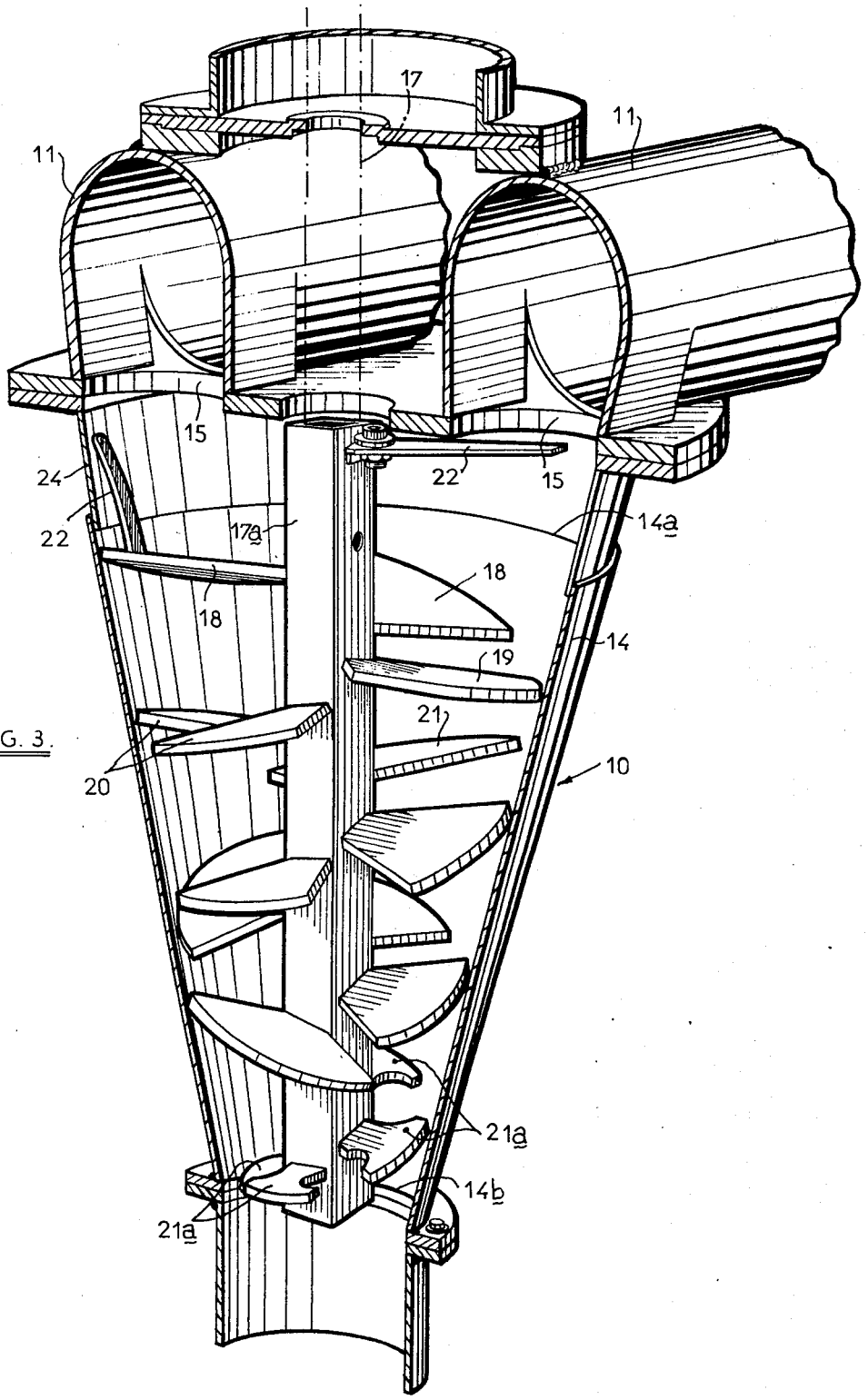

Referring now to FIG. 3, at the discharge end of the assembly of mixer conveyor units 11 there is provided the final discharge chamber 10, the outer casing of which comprises an inverted frusto-conical structure 14 which is attached below the discharge ends of the mixer conveyor units 11 and the discharge from these units passes through apertures 15 into the upper end of the inverted conical chamber 14. Disposed above the mixer conveyor units 11, at the discharge end, there is an electric motor 16 from which a driving shaft 17 extends downwardly and is connected to the shaft 17*a* which extends centrally through the inverted frusto-conical casing 14 to the lower end thereof.

The shaft 17*a* has fixed thereon a number of blades which are at positions spaced axially along the shaft and which are designed and arranged so as to promote a very rapid and intimate mixing of the sand, and catalyst in the relatively short length of the final mixing chamber. For example, it is envisaged that the speed of rotation of the shaft 17*a* would be something of the order of 720 r.p.m. as compared with the speed of rotation of the screw conveyor shafts in the mixer conveyors 11 which would be something of the order of 85 r.p.m.

The blades on the shaft 17*a* are designed not only to mix and propel the mixture towards the lower outlet end of the chamber 14 but also to act upon the mixture in such a way that portions thereof are continually being directed or deflected upwardly against the general downwards flow of the mixture so as to ensure a very intimate mixing and also maintain what is in effect a state of "turbulence" in the chamber 14 so as to avoid the creation of any relatively "dead" spots in which premature setting might commence. To this end some of the blades are disposed so that the general plane of each such blade is in a direction downwardly in relation to the shaft 17*a* whilst with other blades the plane of each such blade is in a direction generally upwardly in relation to the shaft 17*a*.

Considering the upper end of the shaft 17*a* within the chamber 14 there are two such downwardly inclined blades indicated at 18 and herein referred to as mixer blades and one upwardly inclined blade indicated at 19 and herein referred to as a deflector blade. The blades 18 are of approximately the same surface area and the surface area of each blade 18 is approximately half that of the blade 19. One of the blades 18 is spaced axially below the other and blade 19 is spaced axially below the lowermost blade 18 and is arranged so that it lies roughly below the gap between the blades 18 with the result that a proportion of the mixture which is being directed downwardly by the blades 19 is directed upwardly by the blade 19 back into the space occupied by the descending mixture.

Similarly, below the blades 18 and 19 there are two downwardly inclined mixer blades 20 and an upwardly inclined deflector blade 21 and so on towards the lower end of the shaft where the blade sequence changes and finishes with four mixer blades 21*a* and no deflector blades.

The extremities of all the blades are arranged with only running clearance between the blades and the casing 14. Also, the blade arrangement is such that the area swept by the blades' extremities overlap so that the whole of the internal surface of the chamber 14, between the upper end 14*a* and the lower end 14*b* can be kept clean by the sweeping action of the blades. Thus, the apparatus is self-cleaning so far as the interior of the chamber 14 is concerned. The screw conveyors of the mixer conveyor units 11 are arranged to rotate in opposite directions and in such directions of rotatation that at the discharge end of the two screw conveyors discharge their primary mixtures through the openings 15 and in the direction towards the central vertical axis of the mixing chamber 14. The part 24 of the final mixing chamber 10 between the upper end 14*a* of the chamber 14 and the discharge apertures 15 does not have any of the mixer or deflector blades attached to the shaft 17*a*, this being to avoid any of the mixture from the final mixing chamber being deflected back upwardly into the discharge ends of the mixer conveyor units 11. However, this part 24 is provided with two scraper blades, one of which, as shown at 22, is in the form of an arm fixed to the periphery of the upper mixer blade 18 and extending upwardly so as to have rubbing contact with the interior surface of the part 24. The other scraper blade comprises an arm 22 fixed to the upper end of shaft 17*a* and extending radially in relation thereto so as the scrape the areas of the upper side of the discharge apertures 15 and prevent any deposit thereon and build-up of any mixture deflected upwardly from the final mixing chamber.

At the lower end of the discharge chamber 14 there is provided a pneumatically operated sand gate of known form which is not shown in FIG. 3 but which is shown generally at 14*c* in FIG. 1. This gate is for the purpose of providing an initial build-up within the chamber 14 at the commencement of an operation and is opened after a very short period of time to allow discharge of the mixture to commence into moulds and core boxes arranged below. A connection (not shown) is provided in the discharge chamber to permit air to be blown downwardly through the chamber for a cleaning operation when the apparatus is to be shut down. It is important that the chamber 14 should be cleared of any residual sand mixture, upon shut-down, as rapidly as possible to prevent any left-over mixture from setting inside the chamber. It is an advantageous feature of the form of this apparatus that it permits a particularly efficient and rapid cleaning or purging operation to be performed and there is hereinafter given, by way of example, a typical sequence of events for the cleaning cycle to be put into operation upon shut-down of the apparatus.

The first step is the stopping of the two mixer conveyor units 11 so that no further primary mixtures are delivered into the discharge chamber 14 and after the stopping of the two primary mixers the shaft 17*a* is allowed to continue rotating for a 4-second period. The motor 16 is then stopped for a period of four seconds so that the shaft 17*a* is stationary for this period and this is to permit the sand mixture within the chamber 14 to fall under the influence of gravity from one level to another, this being required because rotation of the shaft 17*a* causes some of the mixture to be thrown back upwardly. After this the motor 16 is run again for a period of 3 seconds and during this period the air connection is opened to blast air downwardly through the chamber 14. The motor 16 is again stopped for a further period of 4 seconds to allow further falling of the mixture under the influence of gravity and then after this, for a final period of 5 seconds, the motor 16 is started and simultaneously the air connection opened to provide a final blast of compressed air during this final period of 5 seconds. After this purging operation the sand gate 14*c* is closed.

The above example of a typical cleaning cycle takes a period of 20 seconds and it is envisaged that a suitable electrical type control may be provided to operate an automatic cleaning cycle.

The above mentioned cleaning cycle is envisaged as being necessary when the apparatus is shut down for any substantial period of time but during a continuous production run there may be short periods when the apparatus is stopped (e.g., up to 20 seconds) with no cleaning being necessary.

Preferably, the cone 14 is made in two parts hinged together about a line extending axially down one side of the cone so that the parts of the cone can be separated and swung apart for the purpose of periodic cleaning.

An important practical advantage of the apparatus is its capability of continuous operation to fill a number of moulds or core boxes one after another when working the aforementioned rapid cold setting binders. The combination of mixer blades and deflector blades and their action as above described produces thorough mixing in rapid time whilst also propelling the mixture at high speed downwardly through the mixing chamber 14. The mixture may be discharged directly into moulds and core boxes in appropriate cases or if required may be used in conjunction with a conventional form of core blower with the mixture being discharged from chamber 14 directed to the blowing chamber of the core blower.

However, the apparatus is also capable of being adapted to produce batches of mixtures when required. This can be done in one way by providing automatic time control on the primary mixer conveyor units 11 in combination with the automatic time control for the cleaning and purging operation above described.

What we claim is:

1. Apparatus for producing a foundry mixture of sand and a rapid setting binder comprising:
   - means defining a discharge chamber having a foundry mixture discharge aperture at its lower end for discharging said foundry mixture;
   - means for separately introducing into the upper end of said chamber a sand/binder mixture and a sand-/catalyst mixture;
   - a rotatable shaft extending downwardly and centrally through said chamber;
   - means for rotating said shaft;
   - a plurality of deflector blades fixed to said shaft, each such deflector blade being so shaped and positioned as to deflect downwardly flowing materials in an upward direction;
   - and a plurality of mixer blades fixed on said shaft and shaped and positioned to propel said downwardly flowing materials toward the discharge aperture;
   - said deflector blades and said mixer blades being arranged in groups comprising at least two mixer blades angularly spaced apart and at least one of said deflector blades;
   - each said deflector blade in each of said groups being positioned below and angularly between the mixer blades in each said group.

2. Apparatus according to claim 1 wherein said deflector blades and said mixer blades are spaced along said shaft to provide groups comprising two of said mixer blades and one of said deflector blades at spaced positions along said shaft, the two said mixer blades in each said group having substantially the same surface area.

3. Apparatus according to claim 1 wherein the discharge chamber is of inverted frusto-conical form.

4. Apparatus according to claim 1 wherein said means defining a discharge chamber is a vessel, said blades are inclined, and the peripheral edges of said blades are contoured complementary to the contour of the adjacent interior surface of said vessel to define surfaces of rotation upon rotation of said shaft, the shape of each of said surface of rotation conforming substantially to the shape of a portion of said interior surface, whereby said peripheral edges sweep substantially the whole of said interior surface upon rotation of said shaft.

5. Apparatus according to claim 4 wherein the surface of rotation defined by the peripheral edge of each said blade overlaps the surface of rotation defined by the peripheral edge of another said blade upon rotation of said shaft.

6. Apparatus according to claim 4 wherein said vessel defines a space below said means for introducing said sand/binder and said sand/catalyst mixtures and above the uppermost said mixer blade wherein there is provided a scraper blade fixed on said shaft for cleaning the internal surface of said vessel bounding such space upon rotation of said shaft.

* * * * *

UNITED STATES PATENT OFFICE

CERTIFICATE OF CORRECTION

PATENT NO. : 3,934,858

DATED : January 27, 1976

INVENTOR(S) : Raymond A. Parsonage & Harold Higgs

It is certified that error appears in the above-identified patent and that said Letters Patent are hereby corrected as shown below:

Column 5, line 19: After the word "operation", insert --immediately--.

Column 4, line 26: "19" should be --18--.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*